US008217784B2

(12) United States Patent
Rastegar et al.

(10) Patent No.: US 8,217,784 B2
(45) Date of Patent: Jul. 10, 2012

(54) BATTERY-LESS EMERGENCY DISTRESS SIGNAL AND POSITION INDICATION BROADCASTING METHODS AND DEVICES

(75) Inventors: Jahangir S. Rastegar, Stony Brook, NY (US); Thomas Spinell, East Northport, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 304 days.

(21) Appl. No.: 12/075,177

(22) Filed: Mar. 10, 2008

(65) Prior Publication Data

US 2009/0224908 A1 Sep. 10, 2009

(51) Int. Cl.
*G08B 1/08* (2006.01)

(52) U.S. Cl. ..... 340/539.13; 340/574; 36/103; 36/132; 36/25 R; 36/34 R; 310/339

(58) Field of Classification Search ..... 340/539.13, 340/539.11, 539.1, 531, 500, 574; 36/1, 36/75, 132; 701/213; 342/357.06; 310/339
See application file for complete search history.

(56) References Cited

U.S. PATENT DOCUMENTS

| | | | | |
|---|---|---|---|---|
| 5,022,324 | A * | 6/1991 | Rice, Jr. | 102/201 |
| 5,797,201 | A * | 8/1998 | Huang | 36/132 |
| 5,918,502 | A * | 7/1999 | Bishop | 73/172 |
| 6,011,510 | A * | 1/2000 | Yee et al. | 342/357.09 |
| 6,313,733 | B1 * | 11/2001 | Kyte | 340/7.22 |
| 6,788,200 | B1 * | 9/2004 | Jamel et al. | 340/539.13 |
| 2004/0041498 | A1 * | 3/2004 | Sakai | 310/339 |
| 2005/0037862 | A1 * | 2/2005 | Hagood et al. | 473/345 |
| 2006/0021261 | A1 * | 2/2006 | Face | 36/132 |
| 2006/0103538 | A1 * | 5/2006 | Daniel | 340/574 |
| 2008/0136292 | A1 * | 6/2008 | Thiesen | 310/334 |

* cited by examiner

*Primary Examiner* — Hoi Lau

(57) ABSTRACT

A device for transmitting a distress signal is provided which includes: an impact surface; a power supply for generating electrical energy resulting from an impact force applied to the impact surface; and a transmitter powered by the power supply for transmitter the distress signal. The distress signal can be an RF signal, which can be polarized. The power supply can include one or more piezoelectric generators, at least one capacitor in which the electrical energy generated by the piezoelectric generators is stored and/or an electronics component for regulating a generated voltage and for charging the capacitors. The device can also include a GPS receiver for receiving position data and providing such position data to the transmitter for inclusion into the distress signal.

12 Claims, 5 Drawing Sheets

BATTERY-LESS EMERGENCY DISTRESS SIGNAL AND POSITION INDICATION BROADCASTING METHODS AND DEVICES

BACKGROUND OF THE INVENTION

1. Field of the Invention

The present invention relates generally to devices powered by energy generated by impacts and, more particularly, to emergency distress signal and position indication broadcasting devices and methods.

2. Prior Art

Every year, numerous people get lost in the forests and mountains while climbing or hiking or are lost at sea or while engaged in other land or water sports activities, or when they are otherwise lost due to running out of gas while traveling in remote areas by car or motorcycle, or get stuck in mud or the like or due to mechanical failure, or due to plane crash, and for a number of other reasons. To these numbers, one must also add the number of people who get injured during hiking, skiing or other similar activities, and/or run out of food and/or water and become unable to move to safety on their own. Furthermore, many elderly people can become incapacitated or otherwise injured and incapable of calling for help or medical assistance.

In short, every year, a large number of people find themselves in situations in which they require help for one of the aforementioned or similar reasons. Currently, there are very few devices that are available for those in one of the aforementioned emergency situations to contact authorities or others for help. Among the devices that are currently available are cell phones, which run on battery power and therefore can run out of power, and in most of the above situations would usually be out of reception areas of the phone company. Another currently available device could be a GPS based position indicator and navigation device that could be used by the person to find the way to safety. However, GPS systems are powered by battery and would be useful only if the person is still capable of continuing his/her travel. In addition, GPS signal is not always available, particularly if the traveler is in a mountainous area. Chemical batteries run out and cannot therefore be relied on for emergency situations. Other electrical power sources such as solar cells and mechanical generators such as rotary hand operated dynamo generators may in general be used. However, large solar cell areas are needed to generate enough power, and they could only generate power during the day and under the sun. Dynamo generators and the like are relatively large and heavy and not suitable for hiking and sport activities and can get damaged during accidents and falls, making them unsuitable for many of the other aforementioned emergency situations.

A need therefore exists for methods and means that could be used by a person or persons in one or more of the aforementioned emergency situations or the like to inform authorities or someone who could alert help. To be useful in most situations, such methods and devices should have one or more of the following features: relatively small and lightweight; rugged and capable of withstanding impact and abuse; easy to use even in a highly distressed situations, preferably requiring just a few simple operations to send the appropriate distress signal; battery free; capable of transmitting distress signals, preferably with certain embedded position and/or other relevant information, over relatively long distances, preferably of tens of miles or more; capable of transmitting distress signals from mountainous areas, even from areas deep in the forest and/or from within caves and other similar areas, and have the signal received at the monitoring stations and capable of powering the signal transmitting device without requiring strenuous efforts.

SUMMARY OF THE INVENTION

An objective of the present invention is to provide methods and related devices for transmitting an emergency distress signal and for the monitoring devices (stations) to receive such distress signals that would allow them to be led to and/or locate the person or persons in distress, where the distress signal can be capable of reaching relatively far distances, such as tens of miles.

Accordingly, a device for transmitting a distress signal is provided. The device comprising: an impact surface; a power supply for generating electrical energy resulting from an impact force applied to the impact surface; and a transmitter powered by the power supply for transmitter the distress signal.

The distress signal can be an RF signal. The distress signal can be polarized.

The power supply can comprise one or more piezoelectric generators. The power supply can comprise at least one capacitor in which the electrical energy generated by the piezoelectric generators is stored. The power supply can comprise an electronics component for regulating a generated voltage and for charging the capacitors.

The device can further comprise a GPS receiver for receiving position data and providing such position data to the transmitter for inclusion into the distress signal.

The transmitter can comprise an antenna.

The device can further comprise a microphone and means to record a relatively short message and transmit the same in the distress signal.

The device can further comprise one or more buttons for encoding predetermined information into the distress signal.

The device can further comprise a speaker and means for receiving and reproducing a message on the speaker.

The device can further comprise a display and means for receiving and reproducing a message on the display.

The device can further comprise means for receiving a signal from a third party and broadcasting the signal back to the third party.

Also provided is a shoe comprising: a body; a sole; and a device for transmitting a distress signal integrated into the sole.

The device can comprise: an impact surface associated with a surface of the sole; a power supply for generating electrical energy resulting from an impact force applied to the impact surface; and a transmitter powered by the power supply for transmitter the distress signal.

The impact surface can be disposed in a heel of the sole.

The transmitter can comprise an antenna disposed on the sole.

The shoe power supply can comprise one or more piezoelectric generators.

The power supply can comprise at least one capacitor in which the electrical energy generated by the piezoelectric generators is stored.

The power supply can comprise an electronics component for regulating a generated voltage and for charging the capacitors.

The shoe can further comprise a GPS receiver for receiving position data and providing such position data to the transmitter for inclusion into the distress signal.

Methods for generating the distress signal and broadcasting the same are also included as well as methods for receiving signals from a third party, such as a monitoring station and for determining the position of the device (i.e., the person in need of assistance).

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
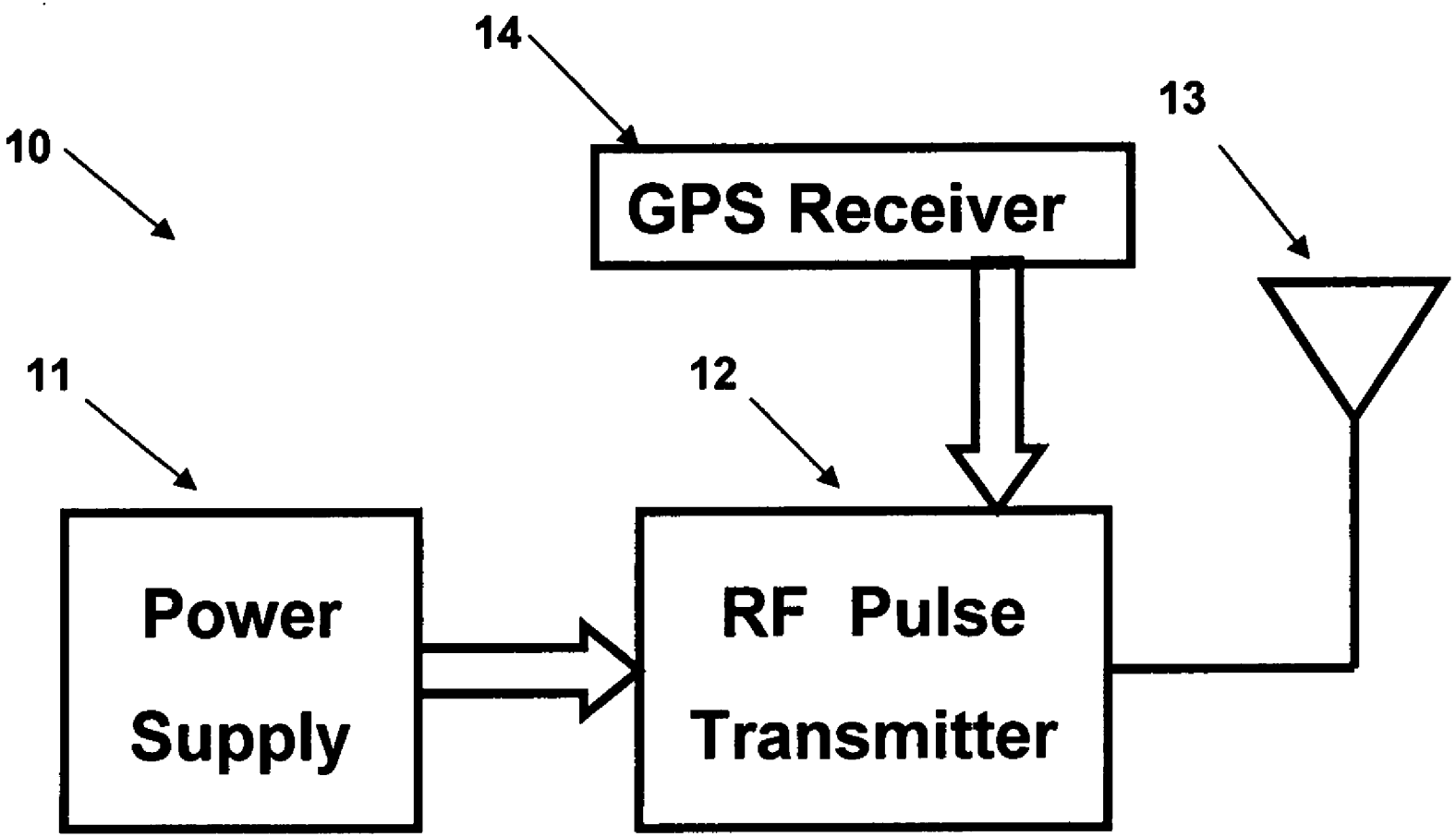
FIG. 1 illustrates a schematical diagram of a disclosed battery-less emergency distress signal and position indication broadcasting device.

In the devices disclosed herein, the distress signal is of a radio frequency nature. The method allows the development of lightweight, small and rugged battery-less devices that are capable of transmitting distress signals from mountainous areas, mountainous areas covered with snow, rain environments or even a rain forest or cave, over the water, and many other locations that a user may find himself/herself. In many of such situations, a radio frequency (RF) transmitter would face numerous obstacles such as reflections, absorption or the natural attenuation of a propagated radio frequency signals as a function of distance. As a result, an RF transmitter would require a considerable amount of power to ensure that a transmitted distress signal could be received at the aforementioned expected distances, such as up to several tens of miles. In the devices disclosed herein, this problem is overcome with the transmission of very high power by very short duration pulses. Methods of incorporating intelligence in the transmitted pulses that would provide additional information to the rescuers that would facilitate their search and/or indicate the conditions of the person(s) in distress and the site are also disclosed herein.

The high power requirement eliminates the possibility of using batteries of typical sizes that can be easily carried by people, particularly considering the size and weight constraints of the present application. In addition, even for the transmission of short but high power pulses, batteries are not appropriate since their rate of discharge is limited and there may not be any means for recharging. One can obviously consider using batteries to charge capacitors and thereby increase the rate of discharge to the desired level. However, in such a scenario, the battery operated transmitter will have a very limited operational lifetime. This would mean that if the person in distress is not found while the batteries are still operational, the person would loose his/her chance of transmitting any more distress signals. It is therefore essential that the electrical power be provided by means that do not rely on chemical or other types of stored energy.

In the devices disclosed herein, the electrical energy is produced by the user of the device. The power source operates based on mechanical impact. The user can then generate electrical energy by impacting the device onto some relatively hard surfaces and generate large enough charges to power the transmitter and allow it to send at least one high power pulse as previously described. The user can then repeat transmission as many times as is necessary and for hours and even days. In addition, the present devices can produce electrical energy and store the energy in one or more capacitors. The stored electrical energy can then be used to produce short but high power radio frequency signals (pulses) that could reach tens or even a few hundreds of miles to allow rescue teams to locate the lost individuals.

The various embodiments of the devices disclosed herein can be constructed by two primary components; an impact-based electrical energy generator power source; and a propagation device capable of producing high-power radio frequency (RF) pulses at one or more frequencies. The resulting battery-less emergency distress signal and position indication devices are then configured and equipped with various other hardware and software to achieve embodiments with different capabilities that could aid the rescuers in locating the person or persons in distress and to inform the rescuers of additional information that would help the rescue mission. To this end, the disclosed embodiments may be equipped with a number of capabilities, including one or more of the following: the distress signal that is transmitted may include a number of frequencies to establish a multiplexed composite signal that will contain information about location of the transmitting device; the distress signal may be time compressed to make it possible to be transmitted with a short duration pulse; the device may be equipped to transmit coded information indicating various medical, food, water, etc., conditions that are entered via simple setting switches or the like; the device may be equipped with a GPS device and the multiplexed signal would then be composed to contain the GPS device indicated position information; a multiplexed signal that will propagate time compressed voice information; a multiplexed signal transmitting a combination of two or more of the aforementioned information; a method to determine distance from the distress signal transmitter, i.e., the person or persons in distress to monitoring station(s) and using the information to locate the position of the transmitter using well known triangulation techniques; a method to determine distance from the distress signal transmitter, i.e., the person or persons in distress to a monitoring station or device and the direction pointing towards the transmitter from the said monitoring station or device; a method to insert a unique code in the transmitted signal of different transmitters for the purpose of enabling the rescuers to identify the transmitted signal and associate it to a single transmitter to eliminate confusion during the rescue operations if more than one distress signal is being transmitted at the time; methods and related devices are also disclosed that could be used at the monitoring stations (fixed or mobile) and by rescue teams, whether on foot, or using certain land or airborne vehicles, to quickly locate the person or persons in distress and effectively navigate towards them.

Referring now to FIG. 1, there is shown a schematical diagram showing two main components of a disclosed battery-less emergency distress signal and position indication broadcasting device, generally referred to by reference numeral 10. The device 10 comprises an impact based electrical energy generator component 11 and a transmitter component 12 with an associated antenna 13. The device 10 is operated by a person in distress by impacting it, preferably to a hard surface such as a large rock or hard ground one or more times. The impact action causes the electrical energy generator 11 to generate electrical energy, which is preferably used to charge at least one capacitor. The stored electrical energy in the capacitors is then used to power the transmitter 12 to transmit short duration and high power radio frequency (RF) pulses from the antenna 13.

Figure 2:
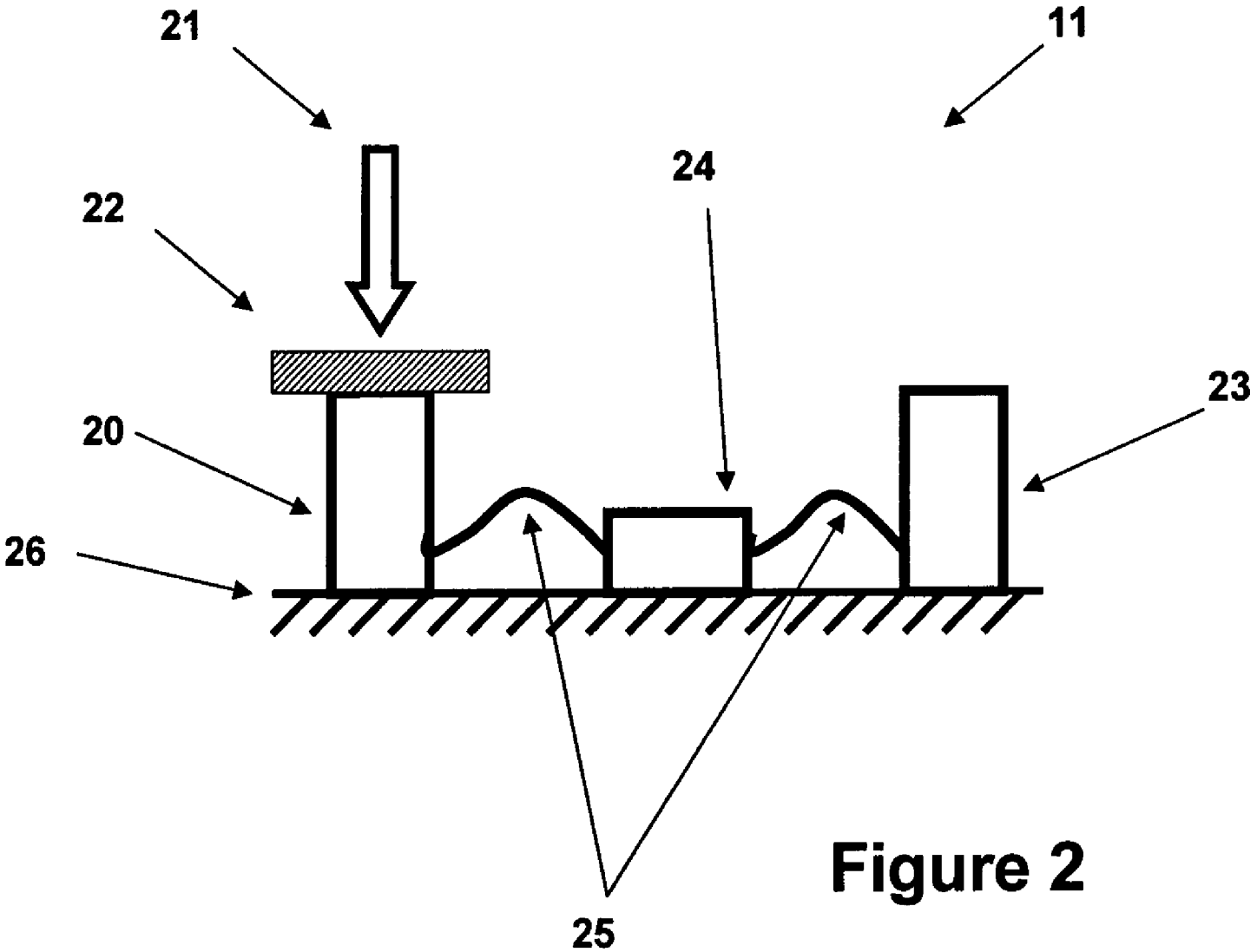
FIG. 2 illustrates the components of the impact based power supply of FIG. 1.

The main components of the power supply 11 are shown in FIG. 2. As shown in FIG. 2, the power supply 11 consists of one or more impact based electrical energy generators 20 (in the schematic of FIG. 2 only one such impact based generator is shown for simplicity). The electrical energy is produced by an impact force 21 imparted on the generator 20. When more than one generator 20 is used, the impact force is preferably applied to an intermediate relatively rigid element 22 to distribute the impact to more than one generator at a time. The impact based generators 20 are constructed as one of the types of impact and vibration based generators described in co-pending patent application Ser. No. 11/447,788 filed on Jun. 6, 2006, the entire contents of which is incorporated herein by reference. The generators 20 can use piezoelectric stacks as described in the aforementioned patent application or magnets and a coil to convert mechanical energy to electrical energy. The use of piezoelectric stack elements allows the generator 20 to be made smaller and lighter. It is appreciated by those familiar with the art that impact type of torque or bending moments may also be used to initialize electrical energy generation by the generators 20.

The power supply 11 also contains at least one capacitor 23, preferably a so-called super-capacitor type of capacitor, in which the electrical energy generated by the generators 20 is stored. In the schematic of FIG. 2 only one capacitor 23 is shown for the sake of simplicity. An electronics component 24 is used to regulate the generated (mainly AC) voltage and charge the capacitors 23. The design, operation and construction of such voltage regulation and capacitor charging electronics are well known in the art. In FIG. 2, wires 25 or other conductors/substrate(s) are used to provide the generated electrical energy by the generator 20 to the regulation and charger electronics 24 and to connect the same to the capacitors 23.

Figure 3:
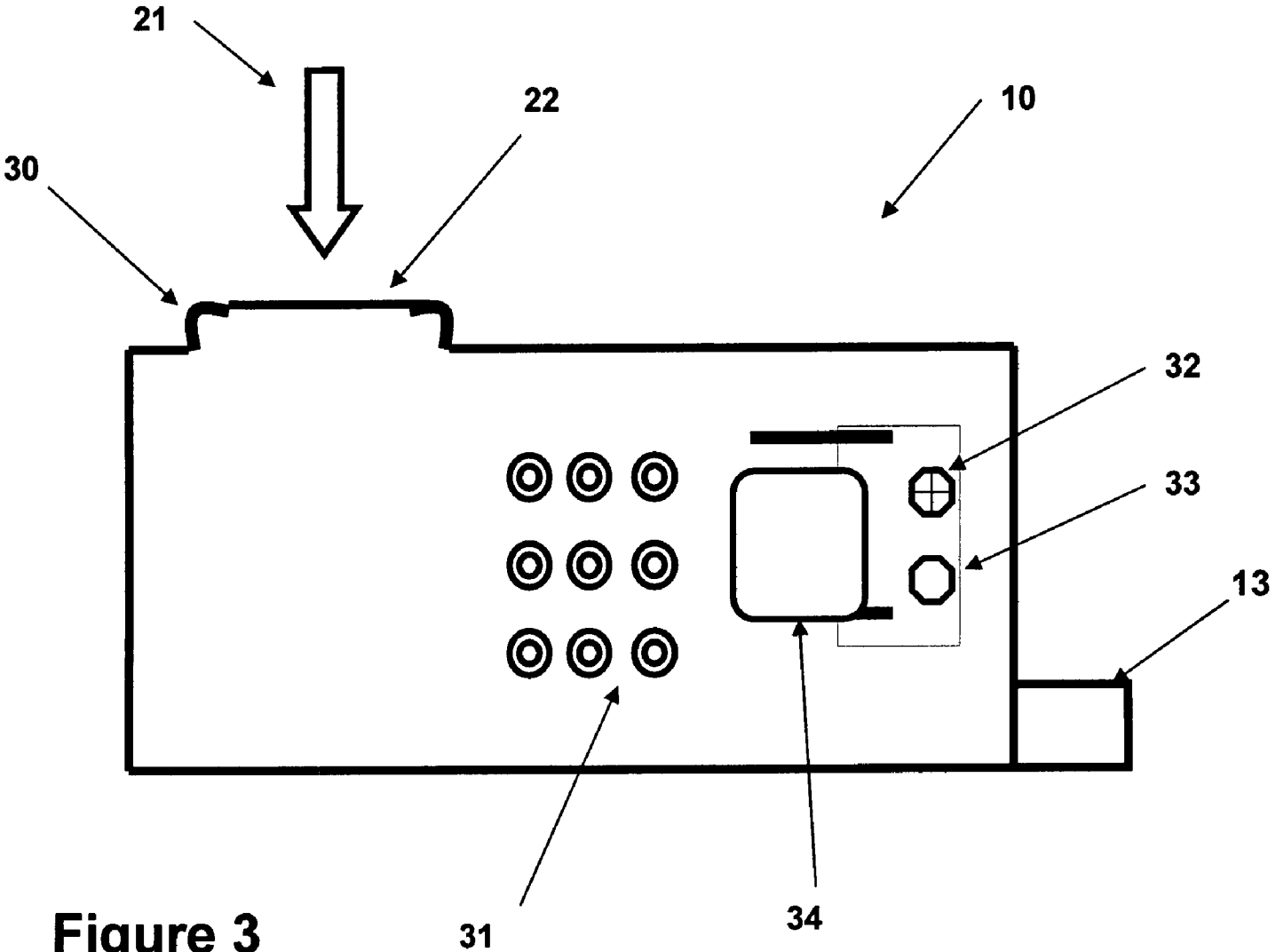
FIG. 3 illustrates a front view of a packaged battery-less emergency distress signal and position indication broadcasting device.

The configuration of the RF pulse transmitter 12 utilizing the electrical energy stored in the capacitors of the power supply 11 is well known in the art. The antenna 13 can be conventionally configured as is shown in FIG. 3. However, the antenna 13 can also be mounted inside the battery-less emergency distress signal and position indication broadcasting device 10 packaging if a portion of the packaging is constructed with RF transparent materials such as plastics. In which case, the antenna 13 is preferably surface mounted inside the packaging wall to make the system more shock and vibration resistant. Alternatively, the antenna 13 may be designed to be deployed from inside the packaged system 10 or unwound as a wire antenna from a storage region on the surface of the package. The latter wire type of antenna 13 is preferable when longer antenna lengths are desired to allow transmission of the longer wavelength RF signals that could reach farther distances.

The packaging of the battery-less emergency distress signal and position indication broadcasting device 10 must obviously be such that the device could withstand the impact forces 21 as well and other shock and impact forces and abuse that could be expected of such a device. In addition, enough sealing of the interior components, particularly around the impact element 22, can be provided to make the device water and moisture resistance. It is noted that different methods of shock and impact proving electronics and other components in a packaging, e.g., by using shock and impact mounts or potting materials, are well known in the art. Methods of hermetically sealing different packaging are also well known in the art and are not described in this disclosure. The impact element (panel or plate) 22 can be attached to the packaging housing via resilient bellow type of material to keep the interior of the package sealed while the transmission of the impact force and vibration of the generator mass-spring elements is minimally impeded.

In another embodiment and as previously indicated, the battery-less emergency distress signal and position indication broadcasting device 10 can be constructed with a power supply 10 that includes a number of storage banks (capacitors or the like) that are electronically gated to each operate a different transmission frequency. The distress signal pulse that is transmitted may then include a number of frequencies to establish a multiplexed composite signal that can contain information about location of the transmitting device. The distress signal may be time compressed to make it possible to be transmitted with a short duration pulse. A transmitter specific code is preferably included in the distress signal to identify which transmitter (particularly if the monitoring station is receiving more than one distress signal at the time) the signal has originated from.

A front view of a packaged battery-less emergency distress signal and position indication broadcasting device 10 is shown schematically in FIG. 3. The impact plate 22 with the preferred resilient bellow type of material sealing 30 to keep the interior of the package sealed without impeding the transmission of impact force 21 and vibration is shown. Also shown are a number of buttons 31 (preferably touch buttons) and, a microphone 32, a speaker 33 and a display 34 with which different embodiments of the present invention may be equipped. Some of the buttons 31 may be two or more position switches. When a microphone 32 is present, the device 10 is equipped with means (preferably solid state memory) to record a relatively short message and transmit the same in the distress signal. The device may also be equipped with prerecorded messages for use, particularly when the user has difficulty speaking messages or speak in the language commonly known by the monitoring station personnel. Similarly, when the device is equipped with a speaker, appropriate means are included in the device 10 electronics to play the incoming message.

In one embodiment, the buttons and switches 31 may be used to encode information such as various medical conditions, immediate medicine needs, the food and/water conditions, the condition of the person or persons in distress, other immediate needs for survival, etc. In one embodiment, one or more of the buttons and/or switches are specifically set to indicate certain conditions such as certain medical conditions or emergency needs.

In yet another embodiment, the user can record a short message and broadcast a multiplexed signal with the time compressed voice information.

In yet another embodiment, the no-battery emergency distress signal and position indication broadcasting device 10 is equipped with a GPS receiver device 14 and the multiplexed signal would then be composed to contain the GPS device indicated position information. It is noted that GPS receivers require relatively small power to operate and can therefore be powered by a fraction of the power that the transmitter portion of the device would require to send the aforementioned signal pulses. The GPS receivers are also very light and small and would therefore add a negligible amount of weight to the total device weight. Thus, the GPS receiver would provide position data to the transmitter and the distress signal may contain such position data.

A multiplexed signal being transmitted can contain a combination of two or more of the aforementioned information.

In yet another embodiment, the battery-less emergency distress signal and position indication broadcasting device 10 can be equipped with an RF receiver. The monitoring station can then send messages that are coded to the aforementioned device specific code. The received messages can then be received, played on the speaker 33 or displayed on the display 34 or recorded for repeated displaying or listening by the person or persons in distress. It is noted that such receivers require relatively small power to operate and can therefore be powered by a fraction of the power that the transmitter portion of the device would require to send the aforementioned signal pulses. The receivers are also very light and small and would therefore add a negligible amount of weight to the total device weight.

In yet another embodiment, the no-battery emergency distress signal and position indication broadcasting device 10 can broadcast back a signal (e.g., a pulse) transmitted from the monitoring station. The monitoring station can then determine its distance to the transmitting device 10 using well known techniques. Then the distance information from at least two monitoring stations positioned in different locations could be used to determine the position of the transmitter device, thereby the person or persons in distress, using well known triangulation techniques.

In yet another embodiment, the no-battery emergency distress signal and position indication broadcasting device 10 can transmit the aforementioned RF pulses, while the receiver at the monitoring station scans the horizon for the direction of a peak signal. As a result, a single monitoring station can determine the location of the device 10 by determining its distance to the device and the direction pointing to the device 10. The process of determining the aforementioned direction becomes significantly more effective and accurate if the transmitted signal from the device 10 is polarized.

The physical configuration of the device 10 can take many forms, such as a small lightweight handheld unit, a key chain fob, or integrated into other equipment that does not ordinarily experience impact forces. The housing of the device 10 can take the form of many shapes, such as tubular, as shown in co-pending patent application Ser. No. 11/447,788 filed on Jun. 6, 2006, the entire contents of which is incorporated herein by reference.

Figure 4:
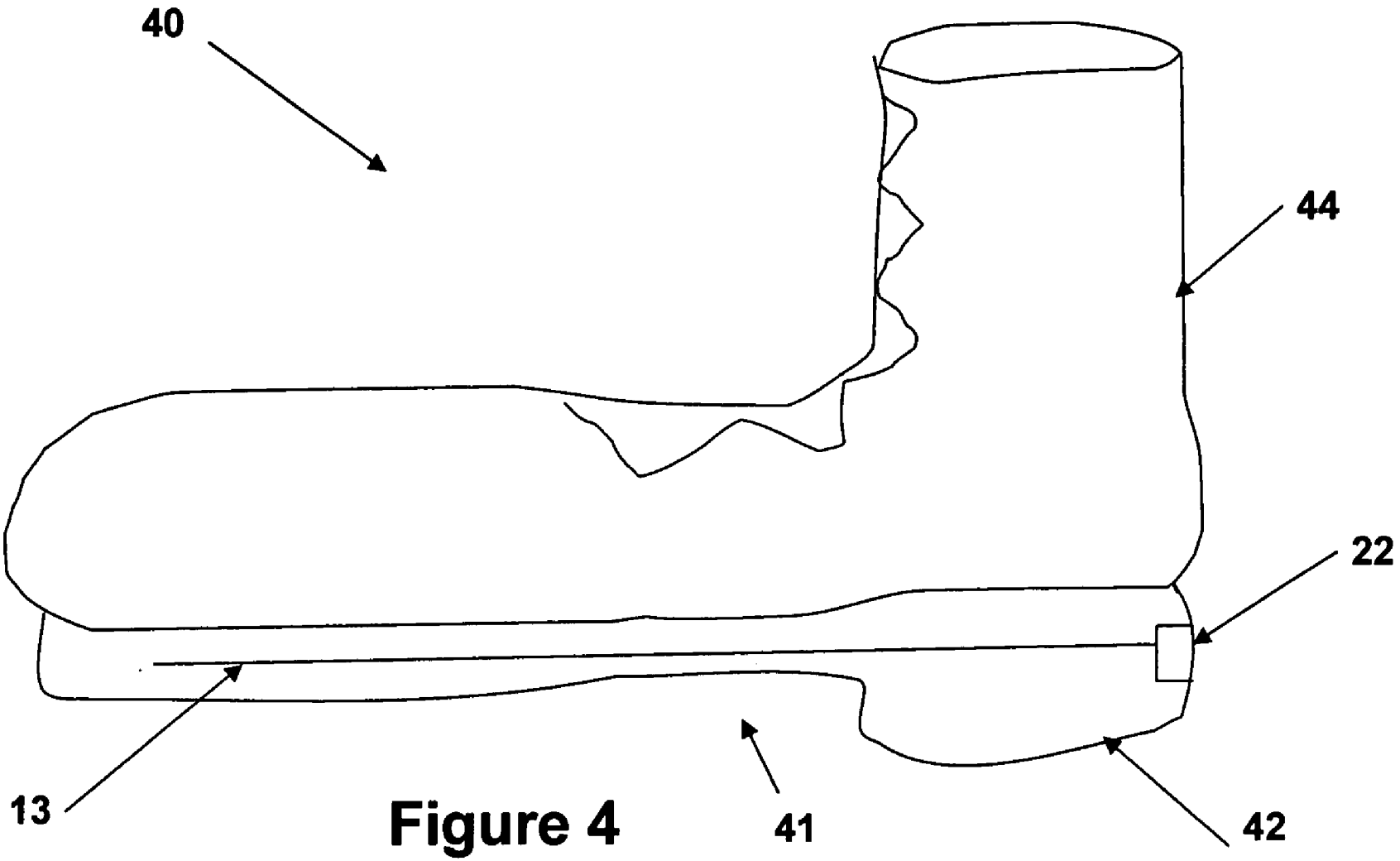
FIG. 4 illustrates an embodiment of the device of FIG. 1 integrated into a boot.

In one embodiment, shown schematically in FIG. 4, the device 10 is integrated into the heel 42 of the sole 41 of a boot 40. In such a configuration, the impact element (panel or plate) 22 can be mounted flush with a surface of the heel 42 such that the impact force 21 can be applied thereto by kicking the heel of the boot against a hard surface, such as the ground, a rock or a tree. Alternatively or in addition, the impact element can be mounted near the front sole of the shoe. The antenna 13 can be mounted as discussed above, or can be mounted on a body 44 of the boot or along the sole 41. However, inadvertent application of the impact force to the impact element 22 would be less likely with the impact element 22 in the heel as shown in FIG. 4.

In all embodiments, a processor can control and/or coordinate the functions with regard to each of the elements/features described above.

Figure 5:
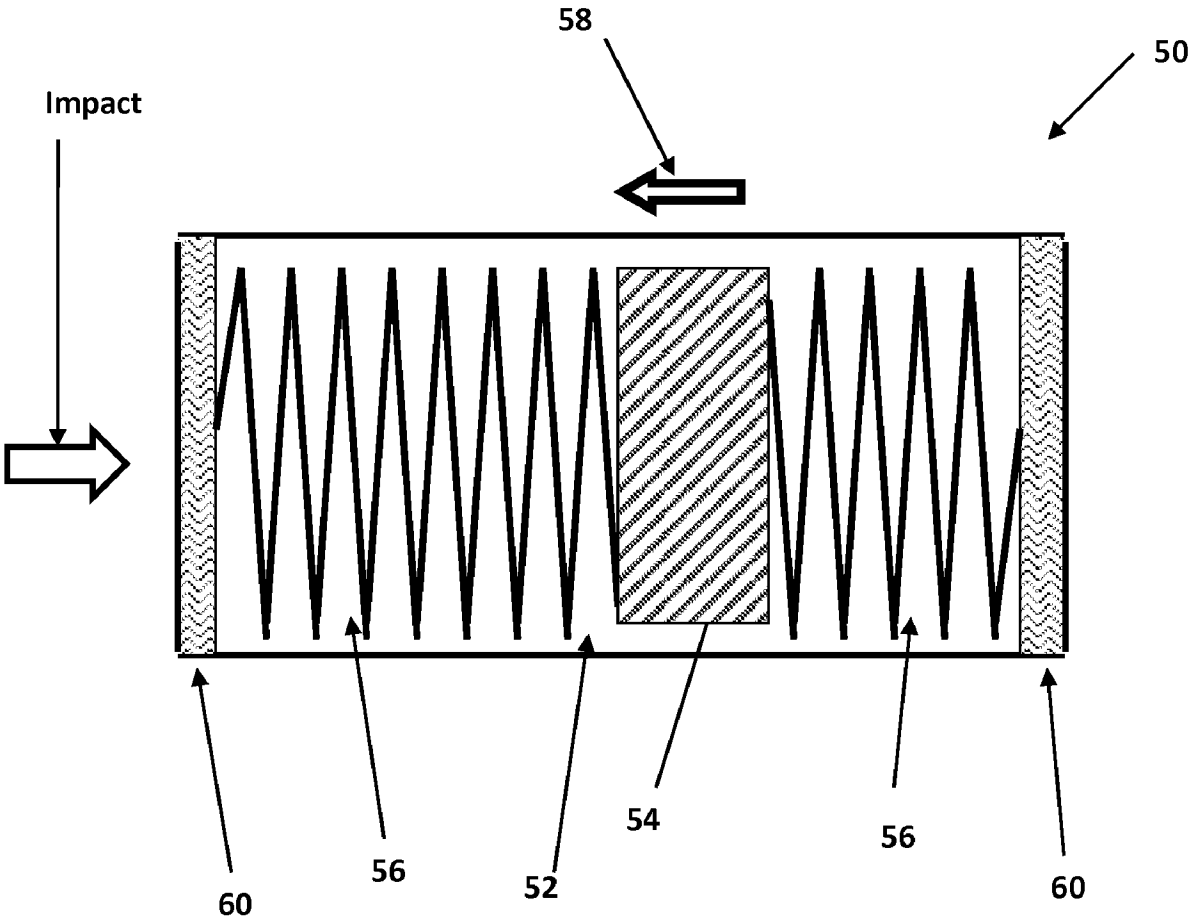
FIG. 5 illustrates a power supply for use in the devices of FIGS. 3 and 4.

Referring now to FIG. 5, there is shown an embodiment of a power supply 50 using an impact (or other impulsive motion) to provide power to transmit the distress signal. The current/voltage from the power supply 50 can use energy harvesting electronics and/or electrical energy storage device (s) as are well known in the art. The power supply can comprise an impact power producing element, such as at least one mass-spring unit 52, with at least one relatively rigid mass 54 and at least one transition element, such as one or more spring elements 56. Although described with regard to an impact, the power supply 50 can also function with the application of other impulsive motions, such as shaking. When the user impacts the impact surface 22 on a relatively rigid surface, the mass 54 is accelerated in the direction of arrow 58 during the duration of the impact.

Following the impact, the mass-spring unit 52 will begin to vibrate. The spring element(s) 56 will then exert a varying force on the piezoelectric elements 60 positioned on at least one end of the spring elements 56, which in turn generate a varying charge with a certain voltage that is harvested by the harvesting and storage electronics and made available to power the RF pulse transmitter 12 or other powered element associated with the device/shoe. As is known in the art, the piezoelectric elements can be made in stacked form, which are widely available commercially, for low voltage applications. As shown in FIG. 5, the mass 54 can be positioned in between two spring elements 56, each of which can exert a varying force on a corresponding piezoelectric element 60 positioned at two ends of the power supply 50. The piezoelectric elements 60 can be electrically connected to the storage electronics or directly to the RF pulse transmitter 12 through appropriate wiring.

The mass 54 can be an integral part of the spring element(s) 56 such as by constructing the entire mass-spring unit 52 with a single spring wire helically wound with at least one compressed coil section, which acts as the relatively rigid mass 54 of the mass-spring unit 52.

Other configurations/variations of the mass-spring unit are possible, such as those described in co-pending patent application Ser. No. 11/447,788 filed on Jun. 6, 2006, the entire contents of which is incorporated herein by reference.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A hand-held electronic device for transmitting a distress signal, the device comprising:

an impact surface comprising a rigid member;

a batteryless power supply connected to the impact surface for generating electrical energy resulting from an impact force applied to the impact surface; and a transmitter powered by the power supply for transmitting the distress signal;

wherein the power supply comprises a mass-spring unit having a mass and at least one spring element connected at a first end to the mass and at a second end to a piezoelectric material such that the impact force results in a vibration of the mass-spring unit whereby the second end of the spring transfers the vibration to the piezoelectric material to generate the electrical energy.

2. The hand-held electronic device of claim 1, wherein the distress signal is an RF signal.

3. The hand-held electronic device of claim 2, wherein the distress signal is polarized.

4. The hand-held electronic device of claim 1, wherein the power supply comprises at least one capacitor in which the electrical energy generated by the piezoelectric material is stored.

5. The hand-held electronic device of claim 4, wherein the power supply comprises an electronics component for regulating a generated voltage and for charging the capacitors.

6. The hand-held electronic device of claim 1, further comprising a GPS receiver for receiving position data and providing such position data to the transmitter for inclusion into the distress signal.

7. The hand-held electronic device of claim 1, wherein the transmitter comprises an antenna.

8. The hand-held electronic device of claim 1, further comprising a microphone and means to record a relatively short message and transmit the same in the distress signal.

9. The hand-held electronic device of claim 1, further comprising one or more buttons for encoding predetermined information into the distress signal.

10. The hand-held electronic device of claim 1, further comprising a speaker and means for receiving and reproducing a message on the speaker.

11. The hand-held electronic device of claim 1, further comprising a display and means for receiving and reproducing a message on the display.

12. The hand-held electronic device of claim 1, further comprising means for receiving a signal from a third party and broadcasting the signal back to the third party.

* * * * *